United States Patent [19]

Selman et al.

[11] 4,061,495

[45] Dec. 6, 1977

[54] PLATINUM GROUP METAL-CONTAINING ALLOY

[75] Inventors: Gordon Leslie Selman; Richard John Midgley, both of London, England

[73] Assignee: Johnson, Matthey & Co., Limited, London, England

[21] Appl. No.: 593,250

[22] Filed: July 7, 1975

[30] Foreign Application Priority Data

July 8, 1974 United Kingdom ..... 30168/74

[51] Int. Cl.[2] ..... C22C 19/05; C22C 30/00

[52] U.S. Cl. ..... 75/134 F; 75/171

[58] Field of Search ..... 75/134 F, 134 N, 171

[56] References Cited

U.S. PATENT DOCUMENTS

| | | | |
|---|---|---|---|
| 408,130 | 7/1889 | Ostermann et al. | 75/171 |
| 2,182,041 | 1/1939 | Szabo | 75/171 |
| 3,053,652 | 9/1962 | Mobley et al. | 75/171 |
| 3,089,769 | 5/1963 | Huschke et al. | 75/171 |
| 3,148,053 | 9/1964 | Spaletta | 75/171 X |

*Primary Examiner*—L. Dewayne Rutledge
*Assistant Examiner*—E. L. Weise
*Attorney, Agent, or Firm*—Cushman, Darby & Cushman

[57] ABSTRACT

This invention relates to platinum group metal-containing alloys comprising, apart from impurities:

a. at least 40 wt.% nickel or at least 40 wt.% cobalt;
b. a trace to 30 wt.% chromium; and
c. a trace to 15 wt.% of one or more of the metals platinum, palladium, rhodium, iridium, osmium and ruthenium.

8 Claims, 23 Drawing Figures

ALLOY F
ALLOY A
ALLOY B
ALLOY C
U.T.S. 1000 psi
TEMPERATURE °C
100
80
60
40
20
200
400
600
800
1000
1200
A
B
C
F ALLOY G
ALLOY D
ALLOY G Aged
ALLOY D Aged
ALLOY G Double Aged
ALLOY D Double Aged
U.T.S. 1000 psi
TEMPERATURE °C
140
120
100
80
60
40
20
200
400
600
800
1000
1200
D
G NIMONIC 90
ALLOY H
ALLOY E
ALLOY H Aged
ALLOY E Aged
U T S 1000 P S I
100
80
60
40
20
200
400
600
800
1000
1200
TEMPERATURE °C A
B
C
1000°C
1100°C
1200°C
U.T.S 1000 P S I
30
20
10
5
0
5
10
15
% Pt
5·07
11·1
14·6

U.T.S. 1000 P.S.I.
140
120
100
80
60
40
20
700
800
900
1000
1100
1200
TEMPERATURE °C
NIMONIC 115 aged
NIMONIC 90 aged
UDIMET 500
NIMONIC 90 soln. tr.
ALLOY E soln. tr.

ALLOY F
ALLOY A
ALLOY B
ALLOY C
% TRUE STRAIN PER HOUR
10
1
$10^{-1}$
$10^{-2}$
$10^{-3}$
1000 °C
250
400
750
1000
2000
3000
4000

ALLOY F
ALLOY A
ALLOY B
ALLOY C
MINIMUM CREEP RATE
10
1
$10^{-1}$
$10^{-2}$
$10^{-3}$
1200 °C
250
400
750
1000
2000
3000
4000
APPLIED STRESS P.S.I.

ALLOY G
ALLOY D
% TRUE STRAIN PER HOUR
10
1
$10^{-1}$
$10^{-2}$
$10^{-3}$
1000°C
250
400
750
1000
2000
3000
4000

ALLOY G
ALLOY D
MINIMUM CREEP RATE
10
1
$10^{-1}$
$10^{-2}$
$10^{-3}$
1200°C
250
400
750
1000
2000
3000
4000
APPLIED STRESS P.S.I.

ALLOY H
ALLOY E
NIMONIC 90
% TRUE STRAIN PER HOUR
10
1
$10^{-1}$
$10^{-2}$
$10^{-3}$
1000°C
250
400
750
1000
2000
3000
4000

ALLOY H
ALLOY E
NIMONIC 90
MINIMUM CREEP RATE
10
1
$10^{-1}$
$10^{-2}$
$10^{-3}$
1200°C
250
400
750
1000
2000
3000
4000
APPLIED STRESS P.S.I.

FIG. 12.
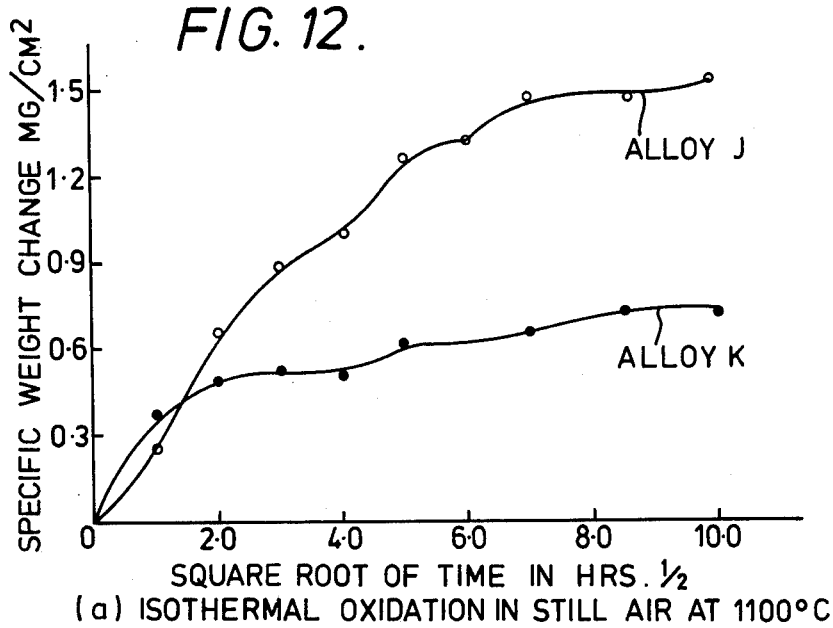
(a) ISOTHERMAL OXIDATION IN STILL AIR AT 1100°C
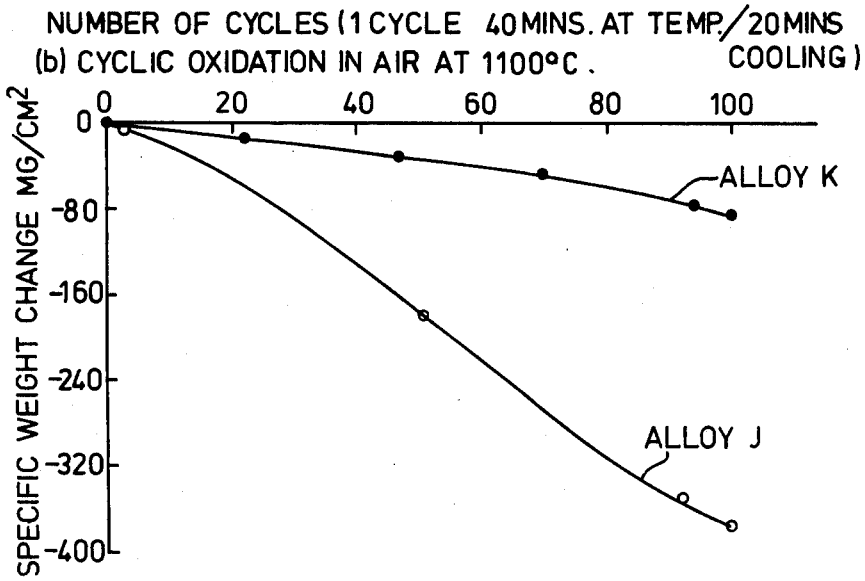
(b) CYCLIC OXIDATION IN AIR AT 1100°C.

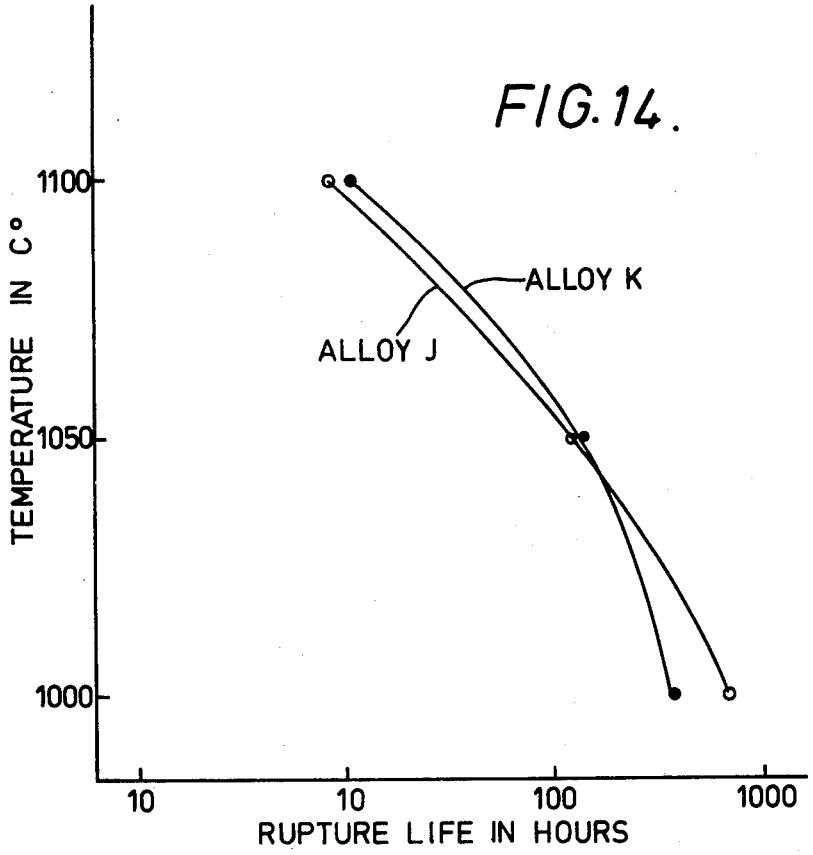
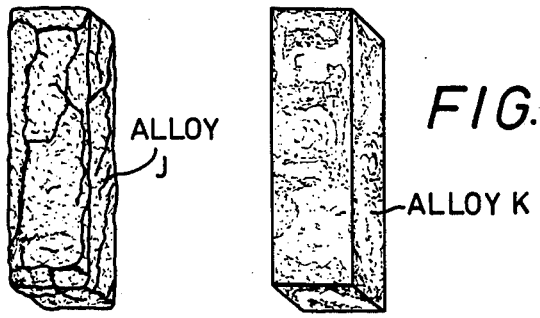
FIG. 16.

ULTIMATE TENSILE STRENGTH LBS/SQ. IN.×10⁻³
80
60
40
20
STRENGTH
ALLOY K
ALLOY J
ELONGATION
ALLOY J
ALLOY K
25
20
15
10
5
% LINEAR ELONGATION ON 1"
1000
TEMPERATURE 1100 C°
1200

ULTIMATE TENSILE STRENGTH LBS/SQ.IN.×10⁻³
50
60
40
20
STRENGTH
ALLOY L
ALLOY M
ALLOY L
ELONGATION
ALLOY M
25
20
15
10
5
% LINEAR ELONGATION ON 1"
1000
TEMPERATURE 1100 C°
1200

FIG. 18.
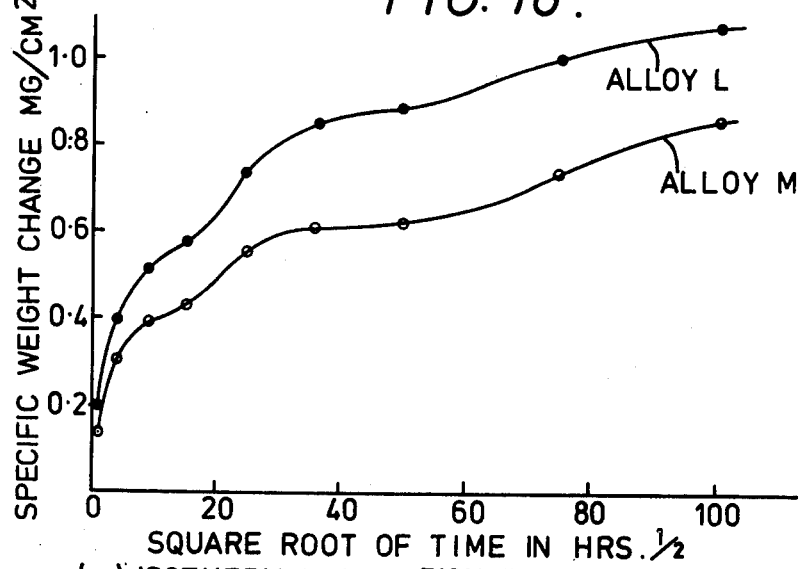
(a) ISOTHERMAL OXIDATION IN STILL AIR AT 1100°C
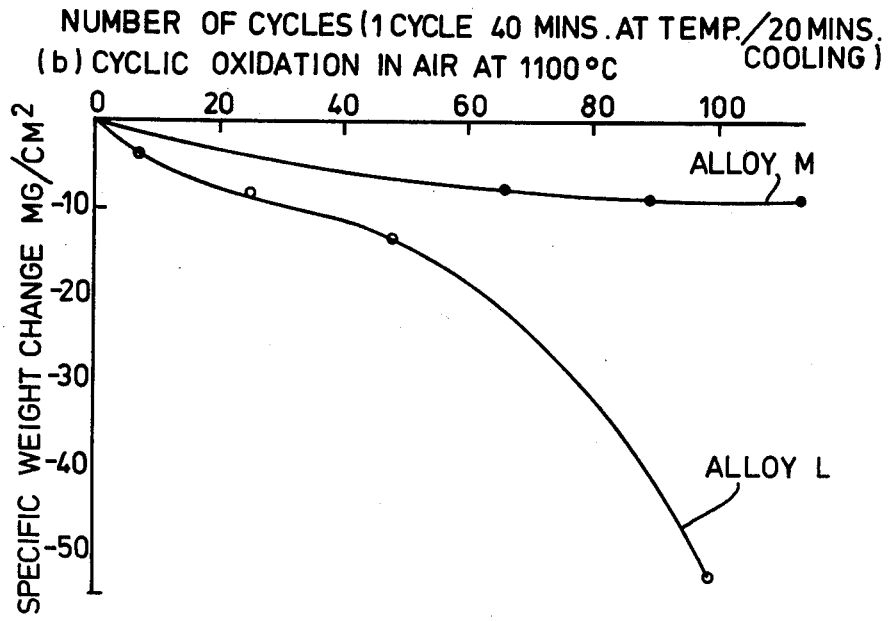
(b) CYCLIC OXIDATION IN AIR AT 1100°C FIG. 21.
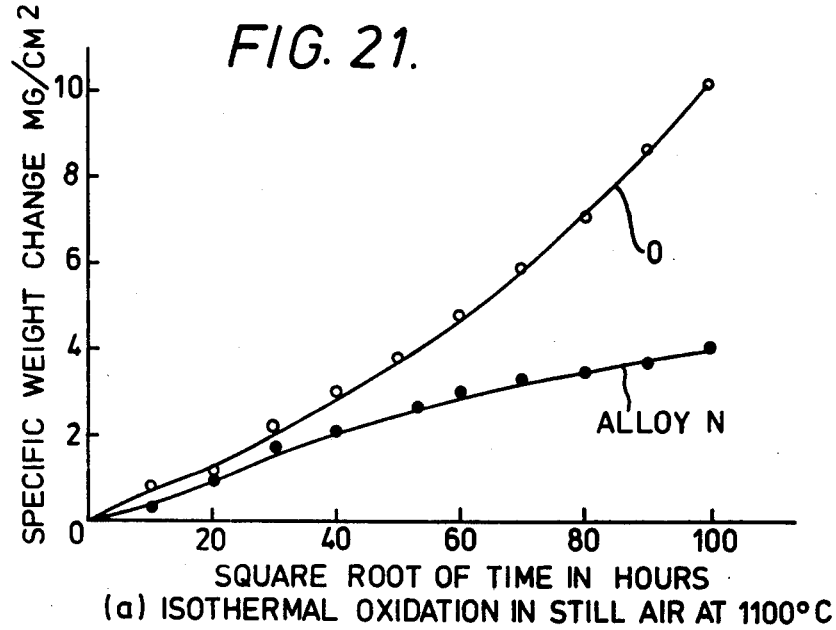
(a) ISOTHERMAL OXIDATION IN STILL AIR AT 1100°C
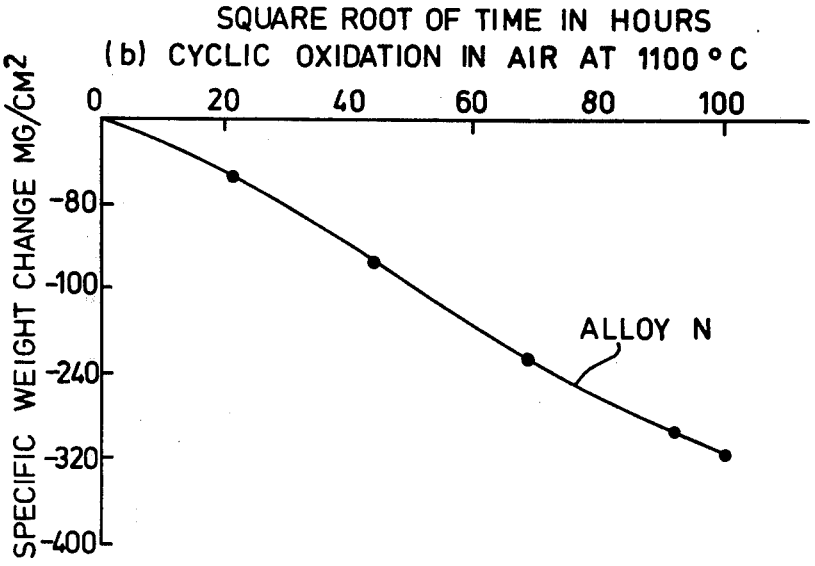
(b) CYCLIC OXIDATION IN AIR AT 1100°C

PLATINUM GROUP METAL-CONTAINING ALLOY

This invention relates to platinum group metal-containing alloys. In particular, the invention is concerned with nickel- or cobalt-based alloys containing platinum group metal. By "platinum group metal" here and throughout the remainder of this specification is meant one or more of the metals platinum, palladium, rhodium, iridium, osmium and ruthenium. By a "nickel- or cobalt-based alloy" here and throughout the remainder of this specification is meant an alloy in which the quantity of nickel or cobalt present in the alloy is greater than that of any other component present in the alloy.

There is a continuing and growing demand in many industries, and notably in the glass industry and in that part of the aero-engine industry concerned with the development of jet engines and gas turbines, for alloys which exhibit increasingly high values of mechanical strength and creep resistance at elevated temperatures and improved oxidation and sulphidation behaviour. It has, indeed, been said that it was the emergence of the thermally resistant "superalloys" which maintain their strength at high temperatures that initially made effective development of the gas turbine possible. These "superalloys" are complex nickel- or cobalt-based alloys with additions of such metals as chromium, tungsten, molybdenum, titanium, aluminium and iron. In the case of nickel based superalloys, the high hot strength is obtained partly by solid solution hardening using such elements as tungsten or molybdenum and partly by precipitation hardening. The precipitates are produced by adding aluminium and titanium to form the intermetallic compound $\gamma'$ $Ni_3(TiAl)$. Stable metal carbides are also intentionally formed in some instances to improve the strength still further.

We have now found that the addition of platinum group metal as herein defined to a nickel and/or cobalt-based alloy, and especially to a superalloy, has the effect of considerably increasing the high temperature strength and creep resistance of the alloy as well as improving the (their) oxidation and sulphidation behaviour. The effect of the addition of one of the said platinum group metals to superalloys is particularly marked, so much so that the addition of platinum group metal to superalloys could lead to materials having useful operating lives at temperatures in excess of 1000° C as well as improving their oxidation and sulphidation behaviour.

Apart from impurities, the alloys according to the invention may have the following compositions, given by way of example.

Composition 1: 40 – 78 (preferably 54 – 78) wt.% nickel, a trace to 30 (preferably 13 – 25) wt.% chromium and a trace to 15 (preferably 5 – 15) wt.% platinum group metal as herein defined.

Composition 2: Composition 1 modified by the addition of one or more of the undermentioned constituents in the amount stated:

| Wt.% a trace to: | |
|---|---|
| 25 | cobalt |
| 6 | titanium |
| 7 | aluminium |
| 20 | tungsten |
| 20 | molybdenum |
| 2 | hafnium |

-continued

| Wt.% a trace to: | |
|---|---|
| 2 | magnanese |
| 1.5 | silicon |
| 2.0 | vanadium |
| 5 | niobium |
| 0.15 | boron |
| 0.05 | carbon |
| 10 | tantalum |
| 3 | zirconium |
| 20 | iron |
| 3 | thorium/rare earth metals or oxides |

Composition 3: not less than 40 wt.% cobalt, a trace to 30 (preferably 13 – 25) wt.% chromium and a trace to 15 (preferably 5 – 15) wt.% platinum group metal as herein defined.

Composition 4: Composition 3 modified by the addition of one or more of the undermentioned constituents in the amount stated.

| Wt.% a trace to. | |
|---|---|
| 25 | nickel |
| 2 | titanium |
| 5 | aluminium |
| 30 | tungsten |
| 5 | molybdenum |
| 5 | iron |
| 10 | tantalum |
| 5 | niobium |
| 2 | manganese |
| 1 | silicon |
| 1 | carbon |
| 0.15 | boron |
| 1.5 | zirconium |
| 3 | rhonium |
| 3 | thorium/rare earth metals or oxides |

The analysed compositions of a selection of five alloys (A to E) according to the invention, and three platinum-free control alloys (F–H) are given below in Table 1.

TABLE 1

| Alloy designation | Alloy Composition - Weight % | | | | | |
|---|---|---|---|---|---|---|
| | Ni | Cr | Co | Ti | Al | Pt |
| A | 75.4 | 17.7 | — | — | 1.06 | 5.07 |
| B | 71.6 | 14.9 | — | — | 1.1 | 11.1 |
| C | 67.3 | 15.9 | — | — | 1.37 | 14.6 |
| D | 71.3 | 12.7 | — | — | 4.09 | 10.14 |
| E | 57.8 | 14.8 | 13.5 | 2.1 | 1.8 | 9.2 |
| F | 77.3 | 19.5 | | | 2.04 | |
| G | 76.4 | 19.3 | | | 3.5 | |
| H | 61.1 | 20.6 | 13.4 | 2.2 | 1.9 | |

The wrought alloy samples A to H were prepared by hot extrusion into rods of vacuum melted and cast 2Kg billets. The rods were solution treated at 1200° C for 20 minutes and then cold-worked down to 0.087 inch diameter wire with intermediate anneals at 1200° C.

Tensile tests were carried out on 8.5 inch lengths of these wires using a Hounsfield Tensometer fitted with a Pt - 10% Rh furnace capable of reaching a temperature of 1400° C.

Tests were carried out on samples of all the alloys listed in Table 1 after solution treatment at 1200° C for 2 hours in cracked ammonia.

Samples of those alloys (D, E, G and H) that were age-hardenable were subsequently subjected to tensile tests after ageing at 1000° C for 16 hours in cracked ammonia following the solution treatment. Two of the alloys (D and G) were also subjected to tensile tests after a two-stage hardening process comprising heat treatment in cracked ammonia for 8 hours at 1080° C and then for 16 hours at 700° C.

BRIEF DESCRIPTION OF THE DRAWINGS

FIGS. 12 to 16 illustrate the mechanical and hot corrosion properties of Alloys J and K.

FIGS. 17 to 19 illustrate the evaluation of Alloys L and M.

FIGS. 20 to 22 illustrate results from the mechanical and corrosion studies of Alloy N.

The results of some of these tests are shown in FIGS. 1 to 3 where ultimate tensile strength is plotted against temperature: in FIG. 1 for the alloys A, B, C and F; in FIG. 2 for the alloys D and G; and in FIG. 3 for samples of a commercial Nimonic 90 alloy and the alloys E and H.

Figure 1:
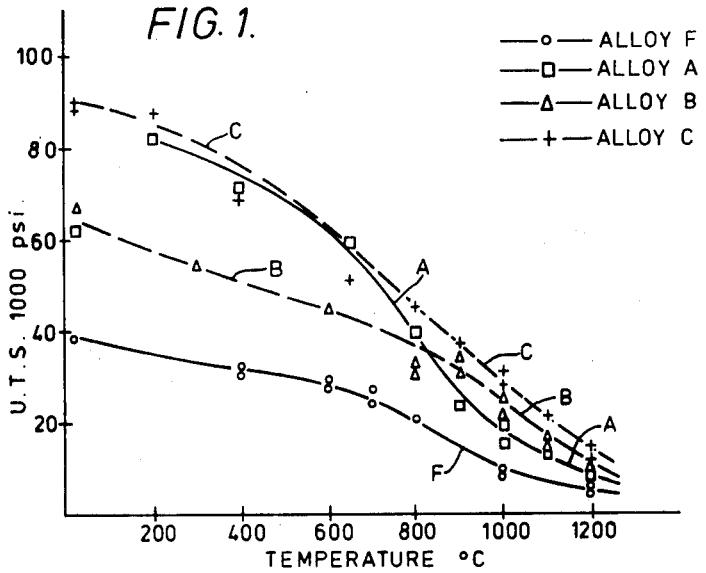
FIGS. 1, 2 and 3 are plots of ultimate tensile strength against temperature for Alloys A–H and Nimonic 90.

As will be seen from FIG. 1, the alloys A, B, C which contain platinum are significantly stronger in the temperature range 1000°–1200° C than alloy F which does not contain any platinum but which is otherwise roughly comparable in composition to alloys A, B and C. The UTS is seen to increase with increasing platinum content and alloy C, containing a nominal 15% of platinum, is roughly twice as strong as alloy F within the temperature range 1000° – 2000° C.

Figure 2:
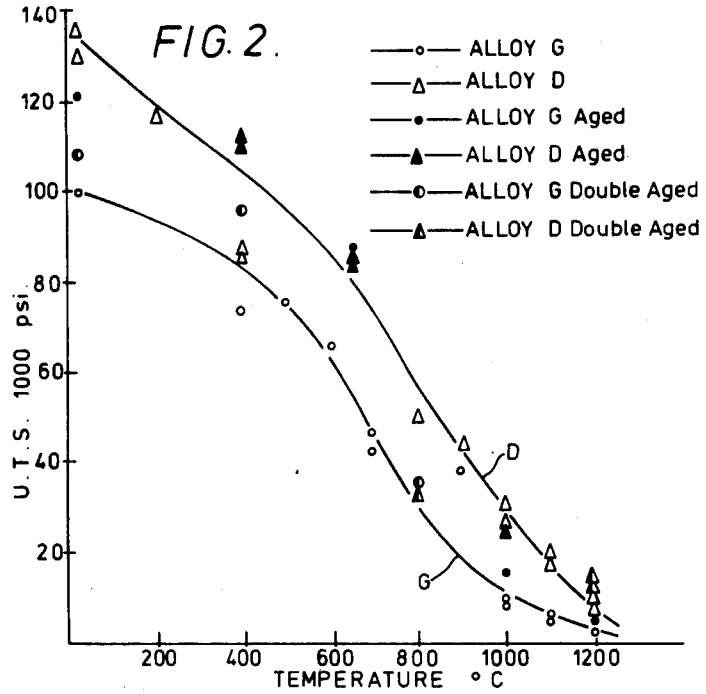
Figure 3:
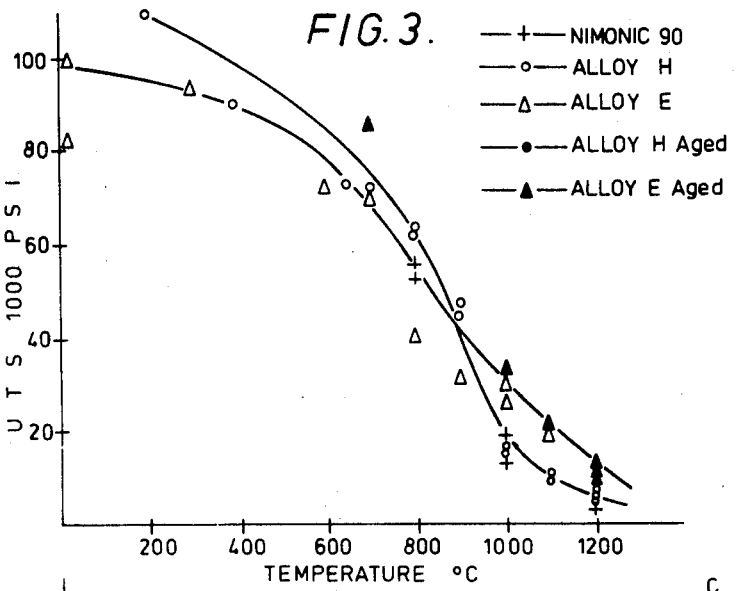

Similar effects for the alloy pairs D,G and E,H are shown in FIGS. 2 and 3 respectively.

Figure 4:
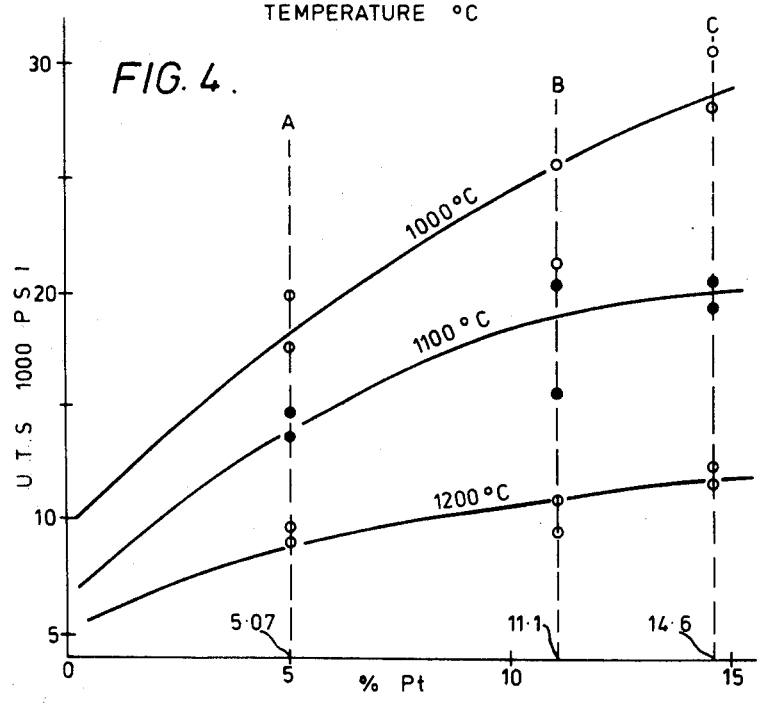
FIG. 4 is a graph illustrating the effect on ultimate tensile strength of platinum addition to Alloy F.

FIG. 4 shows the effect on the UTS, at temperatures of 1000° C, 1100° C and 1200° C, of additions of platinum to alloy F (a Ni-Cr-2Al alloy). The platinum content is plotted along the horizontal axis and, as will be seen, the 5.07% line corresponds to alloy A, the 11.1% line to alloy B and the 14.6% line to alloy C. At 1000° C the increase in strength for each 5% increment in the platinum content is quite large. At 1200° C, however, for strengths of the alloys containing 10% and 15% of platinum are not significantly greater than that of the alloy containing only 5% of platinum.

Figure 5:
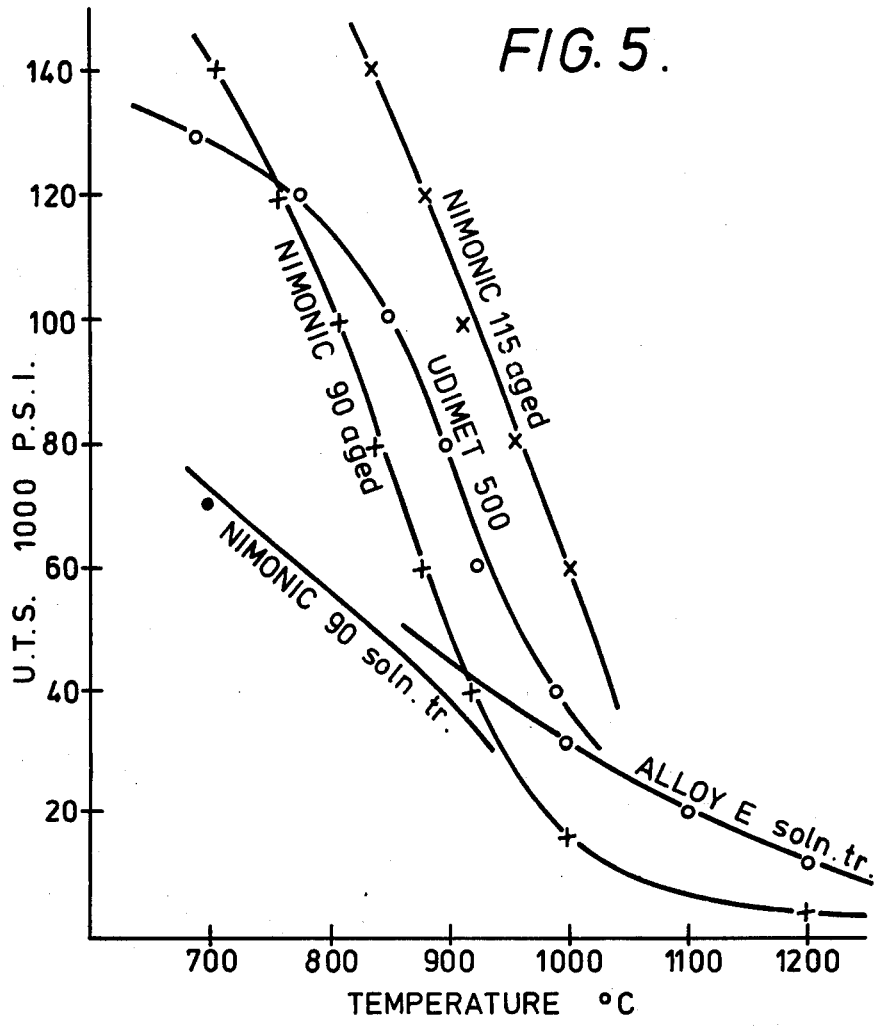
FIG. 5 is a graphic comparison of the experimentally determined high temperature strength of Alloy E with three commercially available alloys.
Figure 6:
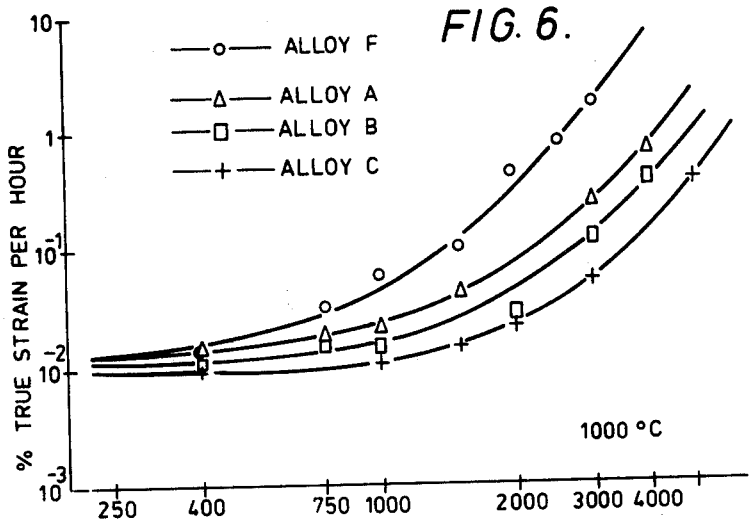
FIGS. 6 to 11 are graphs which plot the minimum creep rate against stress of Alloys A–H and Nimonic 90.
Figure 7:
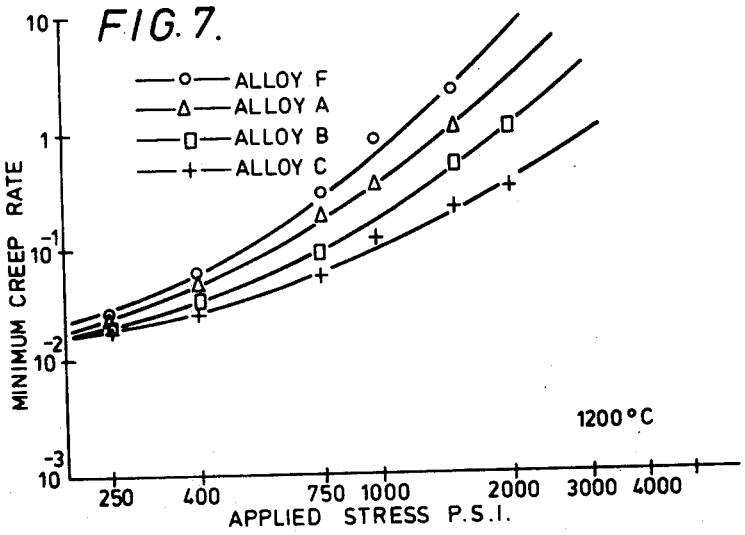
Figure 8:
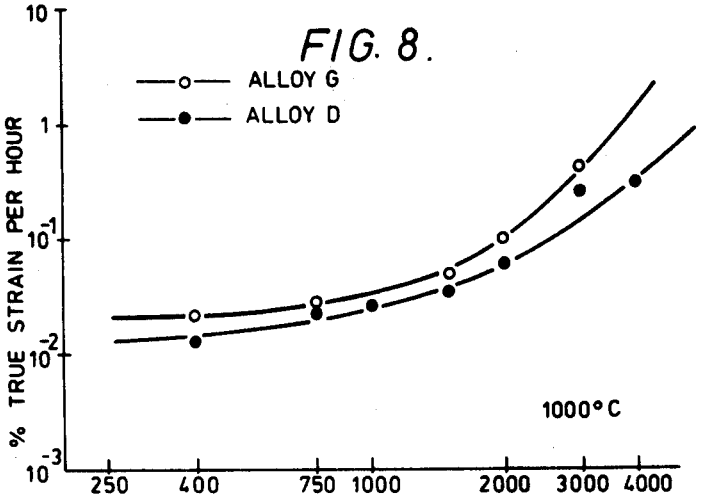
Figure 9:
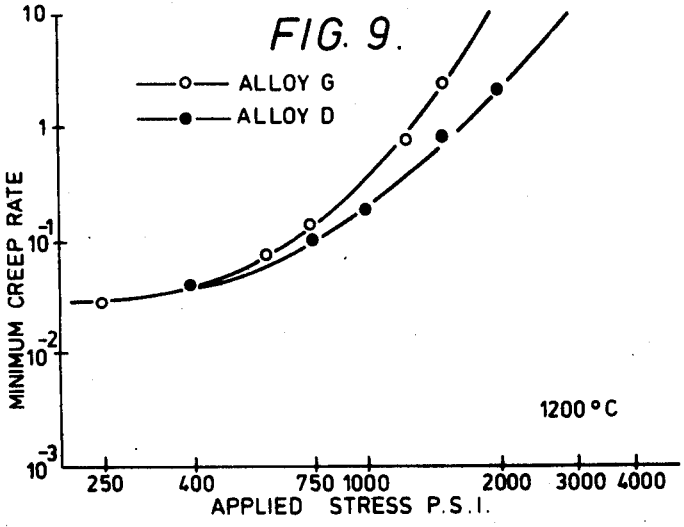

In FIG. 5, the experimentally determined high temperature strength of alloy E - essentially a platinumcontaining Nimonic 90 - is compared with the values quoted in the literature for the three commercially available high strength alloys Nimonic 90, Nimonic 115 and Udimet 500. As will be seen, the strength at temperatures above 1000° C of alloy E in the solution treated condition is comparable to that of Udimet 500 which contains molybdenum as a solid solution strengthener.

The high temperature creep properties of the alloys listed in Table 1 were evaluated under short term constant load conditions of 1000° C and at 1200° C using the interrupted loading technique. The results are shown in FIGS. 6 to 11, in each of which minimum creep rate is plotted against stress firstly for a platinum-free control alloy and then for one or more of the platinum-containing alloys listed in Table 1. In addition, in FIGS. 10 and 11, the results for the commercially available alloy Nimonic 90 are plotted. The evennumbered FIGS. 6, 8 and 10 relate the measurements at 1000° C and the odd-numbered FIGS. 7, 9 and 11 to measurements at 1200° C.

As will be seen, the addition of platinum increased the creep resistances of the alloys in each case. The extent of the improvement in each case depended upon the other components of the alloy, but without exception, it increased with increasing stress. It also increased with increasing platinum content as is evidenced by the results plotted in FIGS. 6 and 7. Here there is an increase in the platinum content of from 0 to 15% in three equal increments of 5% on passing from alloys F to A to B to C and a more or less equal increase in creep resistance for each 5% increase in the platinum content.

Figure 10:
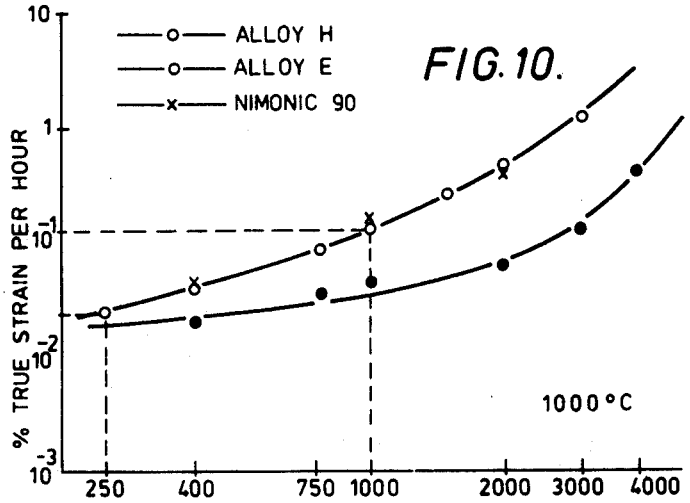
Figure 11:
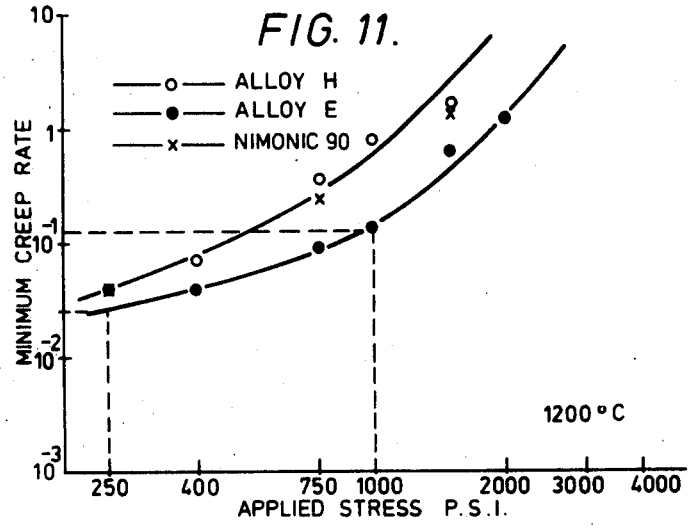
Figure 13:
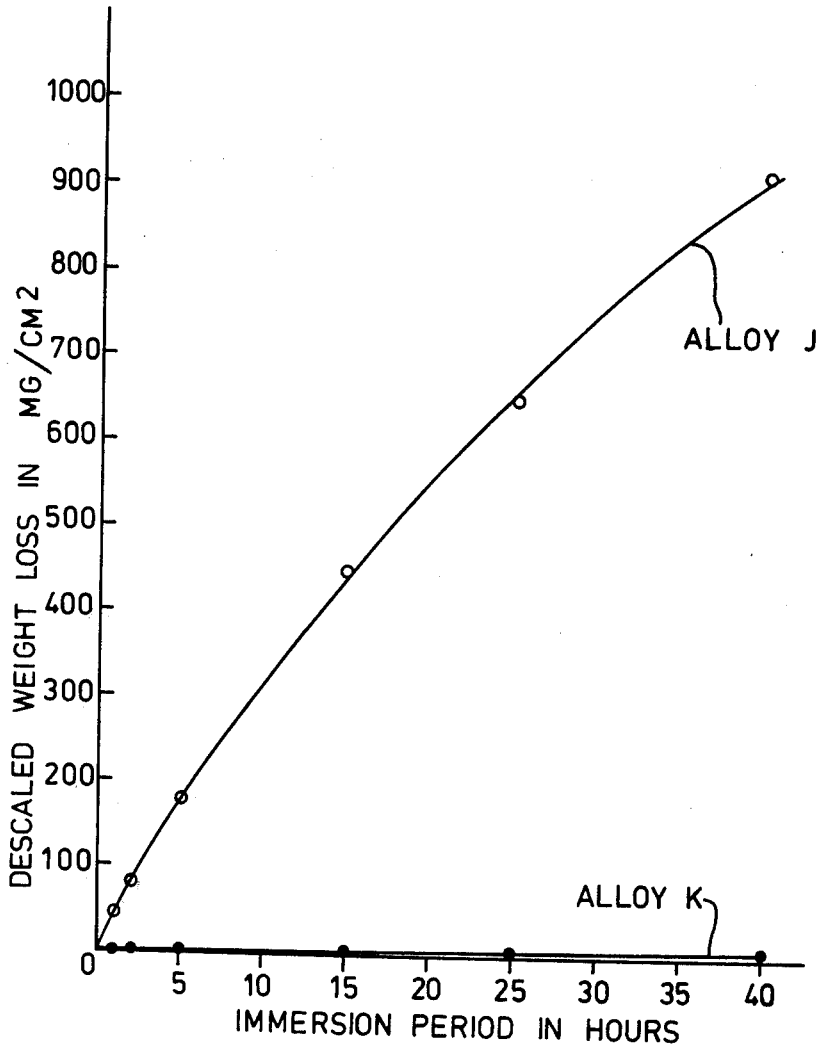
Figure 15:
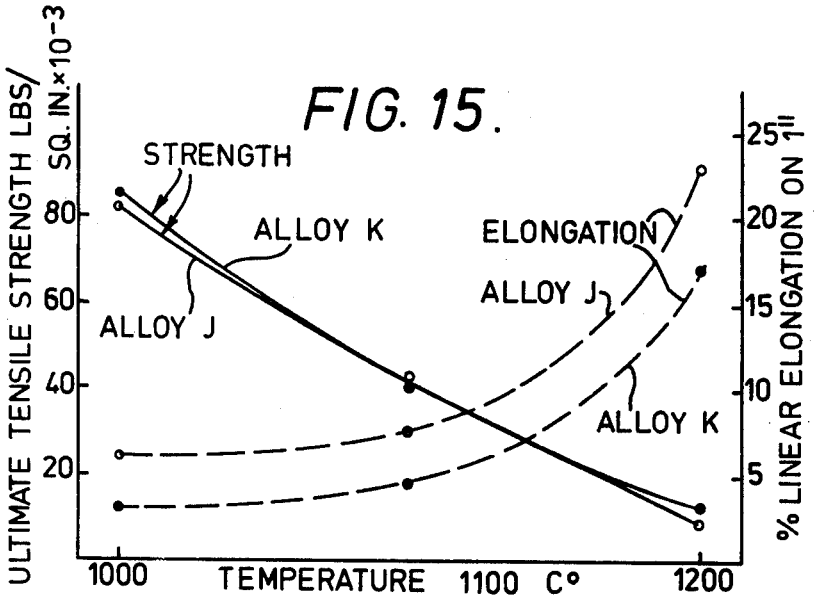

In FIGS. 10 and 11, experimental results obtained with samples of commercial Nimonic 90 are seen to coincide, as expected, with those obtained with a sample of the platinum-free alloy H which has a similar composition. From these two figures it will be seen that the creep rates of alloy E at 1200° C are as low as those of alloy H at 1000° C in the stress range 250 – 1000 psi. It follows that the nominal addition of 10% of platinum to alloy H at the expense of the nickel and the chromium to form alloy E produces a 200° C temperature advantage in this alloy over alloy H and Nimonic 90.

Further tests carried out on samples of the alloys listed in Table 1 included:

a. oxidation tests in still air;
b. oxidation tests in the presence of sulphur;
c. tests to determine the oxidation behaviour of the alloys when subjected to fairly severe thermal cycling; and
d. tests to determine the age-hardening response of the alloys.

The oxidation tests (a) were carried out by preparing sheet samples approximately 1.5 inch × 0.05 inch to a constant surface finish with 320 grade emery and then heating them in a thermogravimetric balance at the temperatures of 1000° C and 1200° C for periods of up to 100 hours. It was found that the platinum-containing alloys D and E which also contained significant quantities of aluminium, or of aluminium and titanium exhibited a reduced rate of oxidation compared with the corresponding control alloys G and H respectively, especially at 1200° C.

The oxidation tests (b) were carried out by repeating tests (a) but with the use of samples pre-coated with sodium sulphate. Sulphur is known to cause a considerable increase in the rate of oxidation and depth of oxide penetration in nickel- and cobalt-containing high temperature alloys and similar effects were observed in the alloys under test. Resistance to sulphur-accelerated oxidation is an important requirement of an alloy for use in marine applications. The tests showed that at 1200° C the depth of oxide penetration in an alloy (such as alloy B) containing about 10% platinum was approximately half that in the corresponding platinum-free alloy (such as F). At 1000° C, however, not a great deal of difference was in evidence.

The thermal cycling tests (c) were carried out by maintaining small samples of sheet at 1000° C or 1200° C in air for 24 hours, water quenching them and then repeating the cyle four times. All samples of the alloys showed some spalling of the oxide film during the quench, but the platinum bearing alloys seemed less prone to this effect.

Assessment of the age-hardening response (test (d)) was carried out by solution treating samples of alloys H and E by annealing them for 2 hours at 1200° C and then determining the variation in hardness with ageing time and temperature. The platinum in alloy E seemed to have no effect of the optimum ageing temperature, but alloy E showed far less tendency to overage at 800° C than alloy H. This suggests that, in some way, the platinum was stabilizing the precipitating phase.

In addition to the wrought alloys A to H, cast nickel base and cobalt base alloys were prepared and evaluated under tensile, creep rupture, oxidation and corrosion tests. Cast nickel and cobalt alloys are usually preferred for turbine blades, vanes, and guide nozzles since they possess good stress rupture properties and can be cast using precision casting techniques into aero foil and other shapes containing an array of complex cooling passages.

It is believed that the cast nickel base alloys owe their improved strength to a combination of factors of which increased solid solution hardening of the $\gamma$ matrix and volume percentage increases in the $\gamma'$ phase precipitate are the most important, and are obtained by increasing additions of refractory metals, tungsten and molybdenum and $\gamma'$ forming elements, aluminium and titanium respectively. Generally, the volume percentage of $\gamma'$ phase present in the highest temperature capability nickel base alloys is commonly between 50–60%. The improvements in strength of these materials has only been achieved however at the expense of oxidation and hot corrosion resistance, as in order to avoid undesirable $\sigma$ phase precipitation, the chromium content of the alloy is, preferably, reduced to 5–12 wt.% range with increasing refractory metal addition.

In contrast to the nickel base superalloys, the cobalt base superalloys rely mainly on solid solution strengthening and a multitude of carbide phases intentionally developed for secondary strengthening purposes. The cobalt base alloys are intrinsically more resistant to sulphur accelerated oxidation than the nickel base varieties, though above 900° C when oxidative corrosion processes predominate, the cobalt based materials tend to corrode more rapidly. Casting of cobalt base alloys is employed largely for convenience and economic reasons rather than for any basic unworkability as in the case of the nickel base alloys.

Platinum enrichment of the nickel and cobalt alloys hereinafter discussed was obtained using vacuum induction melting and investment casting techniques. For example, in the case of the nickel alloys, nickel shot was premelted in a PUROX alumina crucible in a vacuum induction furnace having a facility for introducing a desired atmosphere prior to preparation of the alloy. Initially, melting was carried out in a hydrogen atmosphere, thereafter the melt was vacuum degassed and finally cast into cylindrical bar stock under ½ atmosphere or argon.

Other compounds were added as follows:

Tungsten: The tungsten powder was compacted into 1¼ inch dia pellets and hydrogen sintered at 1400° C for 4 hours prior to use.

Cobalt, niobium, aluminium, titanium and zirconium: Each of these constituents was pickled free from oxide before use.

Platinum, chromium, carbon and boron: Used in the "as received" condition.

The pre-melted nickel, sintered tungsten, pickled cobalt, one half of the chromium content and all the carbon (plus all the platinum grain in enriched compositions) was charged to the crucible. The base alloy charges were prepared first to avoid platinum carry over into subsequent melts. Initial melt down was under ⅓ atmosphere hydrogen and the ensuing melt was degassed by evacuation to $10^{-3}$ torr once the initial boil had subsided. The temperature of the melt was kept to a minimum during this period to restrict crucible/melt reaction. Additions to the melt via the hopper were made in the following sequence:

1. Second half of the chromium content at 0.2mm Hg.
2. Aluminium content at 1.0 mmHg.
3. Titanium content at 1.0 mm Hg.
4. Niobium content at 1.0 mm Hg.
5. Backfill to ½ atmosphere with argon and add zirconium and boron.

The melt temperature was then adjusted to 1460° C and the alloy cast into 1 inch × 2½ inch section skillet moulds to produce an 8 inch long ingot.

Using the above procedure and subsequent shell casting techniques, specimens for analysis and test were prepared having the compositions shown in Table 2 below:

TABLE 2

| Alloy Designation | Alloy Composition - Weight % | | | | | | | | | | | | | |
|---|---|---|---|---|---|---|---|---|---|---|---|---|---|---|
| | Ni | Cr | Co | W | Nb | Al | Ti | C | B | Zr | Pt | Mo | Ta | Hf |
| J | 63.0 | 8.0 | 9.5 | 11.5 | 1.6 | 4.2 | 1.7 | 0.07 | 0.01 | 0.1 | — | — | — | — |
| K | 53.0 | 8.0 | 9.5 | 11.4 | 1.5 | 5.1 | 1.7 | 0.09 | 0.02 | 0.07 | 9.9 | — | — | — |
| L | 63.3 | 8.0 | 10.0 | — | — | 6.0 | 1.0 | 0.10 | 0.015 | 0.10 | — | 6.0 | 4.0 | 1.5 |
| M | 53.3 | 8.0 | 10.0 | — | — | 6.0 | 1.0 | 0.10 | 0.015 | 0.10 | 10.0 | 6.0 | 4.0 | 1.5 |
| N | 10.0 | 23.5 | 44.7 | 7.0 | — | — | 0.2 | 0.6 | — | 0.5 | 10.0 | — | — | — |

In the above Table nickel base alloy K is a platinum modified enriched alloy version on alloy J and nickel base alloy M is a platinum modified enriched version of alloy L. Alloy N is a platinum modified enriched version of cobalt base alloy.

Room temperature hardness determinations were performed using a pyramid indentor under a load of 10 kgs and values quoted in Table 3.1 and 3.2 represent the average of at least twenty impressions.

Tensile tests were conducted in air at room temperature, 1000° C, 1100° C and 1200° C. Testing was conducted using an Instron Universal testing machine at a constant crosshead speed of 0.1 cm/min. For the elevated temperature tests, a furnace control of ± 2° C was maintained and duplicate specimens were run for all tensile test conditions.

Stress Rupture testing was performed in air using a Denison creep testing apparatus under constant load conditions. Specimen extensions were continuously monitored through sixdecade displacement transducer modules. Stress rupture lives and minimum creep rate values were determined from creep curves derived at 1000° C, 1050° C and 1100° C respectively. Constant loads corresponding to 15,000 psi were applied for all the tests in the current programme. Furnace control was maintained to within ± 2° C, and duplicate specimens were run for all test conditions.

Isothermal oxidation characteristics of the alloys were determined using a thermogravimetric balance. Test specimens were prepared by grinding rectangular pieces ¼ inches × ¼ inches × 1 inches to a 600 grade emery finish before placement in pure alumina crucibles and isothermally heating at 1100° C for periods of 100 hrs. In addition to the automatic weight change against time printout, the specimens were examined metallographically after testing to determine oxide penetration.

Cyclic oxidation: The effect of temperature cycling between 1100° C and room temperature was determined in still air for a total time at temperature of 70 hrs. Each cycle consisted of 40 mins heating at temperature followed by 20 mins cooling to room temperature. When withdrawn from the furnace the specimens were surrounded by a spall shield and spall cup in order that the oxide spallation could be collected, weighed and analysed. Weighments were taken periodically to allow the progress of the test to be monitored (see Table 5.2).

The effect of sulphur accelerated oxidation was evaluated by total immersion of samples of the alloys for varying periods in a salt mixture containing 10% NaCl and 90% $Na_2SO_4$. 1 inches × ¼ inches × ¼ inches section pieces prepared to a 600 grade emery finish were suspended from platinum wires into recrystallized alumina crucible containing the salt mixture. After the immersion period at 925° C the samples were removed, water washed and weight prior to descaling using a proprietory sodium hydroxide plus activators and inhibitors salt. Further water washing and acid pickling produced a scale-free bright surface and enabled the calculation of a de-scaled weight loss figure.

The non platinum enriched modified alloys used were Martin Marietta alloys and alloy J was chosen for investigation on account of its high temperature capability and because it contained a single matrix solid solution strengthener, i.e. tungsten. The platinum modification of this alloy, i.e. alloy K, was prepared with a 10% by weight addition of platinum made in substitution for a proportion of the nickel content. The composition of the platinum enriched modified alloy K was determined by chemical analysis and is given in Table 2.

Tables 3 to 6 and FIGS. 12 to 16 illustrate the mechanical and hot corrosion properties of the alloys J and K and from these Tables and graphs, it will be seen:

a. The Platinum modified enriched alloy K displays an improvement in hot strength and creep resistance at the highest test temperatures, i.e. above 1100° C; and
b. The corrosion resistance of the platinum modified enriched alloy K is vastly superior to the alloy J under isothermal oxidation conditions. The isothermal oxidation improvement is by a factor of two, cyclic oxidation by a factor of five and from the performance in the sulphidation 'crucible' test, by a complete order of magnitude. Pictorial evidence for the improvement in sulphidation resistance is shown in FIG. 16, where the right hand drawing (alloy K) shows practically no spalling when compared with the left hand drawing (alloy J).

Figure 17:
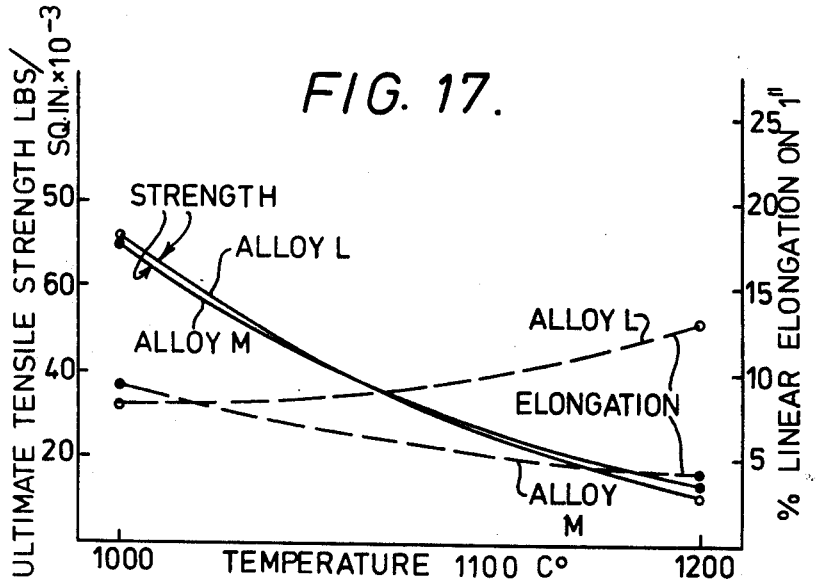
Figure 19:
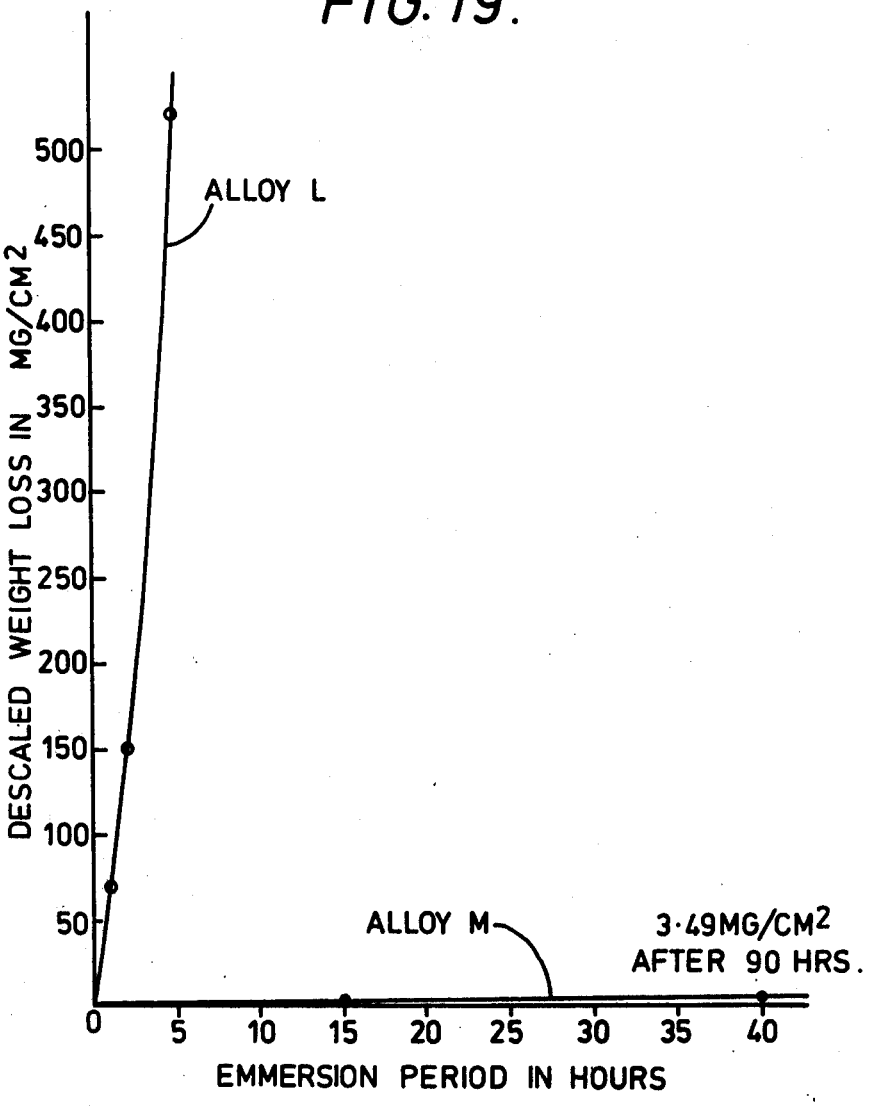

Alloy L (Table 2) is a hafnium modified alloy which has improved creep ductility in the intermediate temperature range. The nominal compositions of alloys L and M were prepared as previously described with the platinum addition made in part substitution for part of the nickel content of the alloy L which contains two matrix strengtheners molybdenum and tantalum. Tables 7 and 9 and FIGS. 17 to 19 illustrate the results of the evaluation of these alloys and demonstrate identical behaviour to the alloys J and K.

Alloy N is a cobalt base alloy containing tungsten and tantalum as the primary strengthening agents having the composition shown in Table 2.

Figure 20:
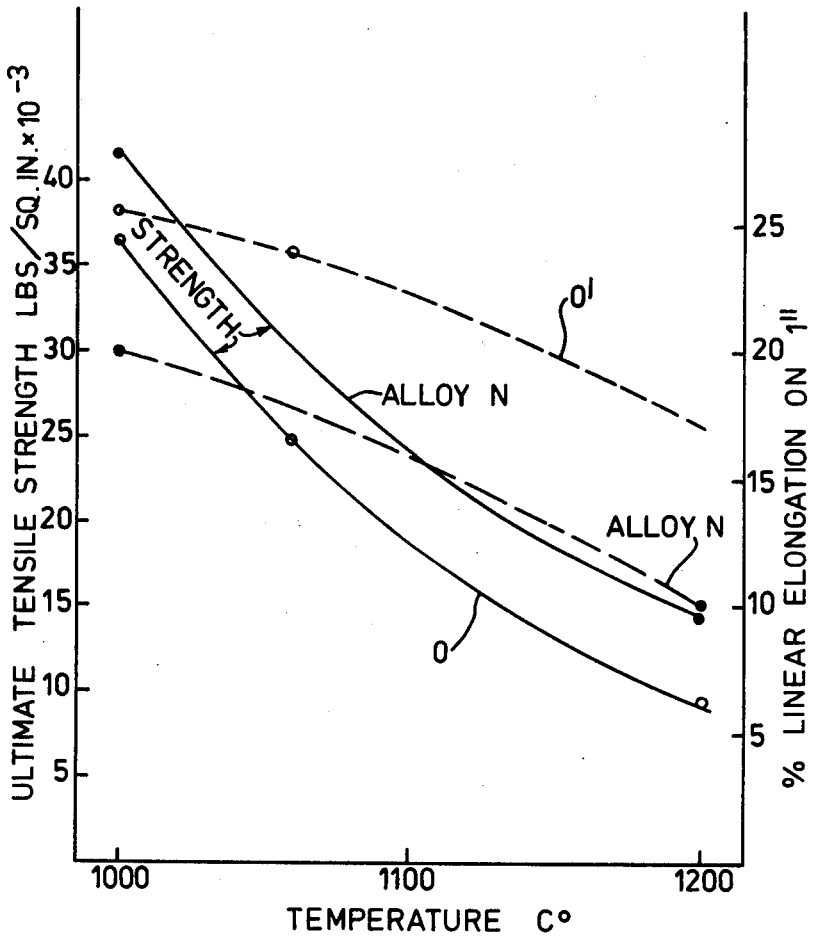
Figure 22:
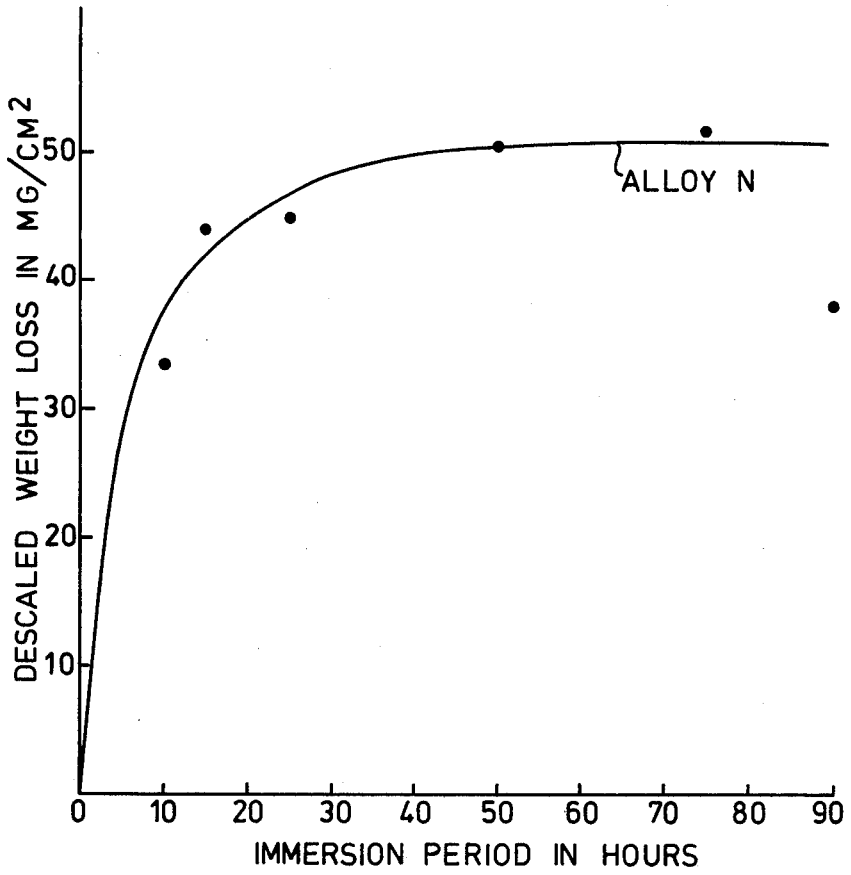

The platinum enriched modified alloy N was made in part substitution for a proportion of the cobalt content of the alloy. The results from the mechanical and corrosion studies of this alloy are shown in Tables 10 to 12 and FIGS. 20 to 22 in which graphs designated 0 and 0' were prepared using data from MAR M509 Alloy Digest November 1967. From these Tables and figures it is evident that improvements in elevated temperature strength, at the expense of ductility, is achieved for the alloy N. The measured ultimate tensile strength at 1200° C of the platinum containing alloy N is superior to that of any of the cobalt and nickel base alloys and any of the platinum enriched nickel base alloys referred to herein. The corrosion behaviour of alloy N is superior to that of the platinum free cobalt base alloy enriched nickel base alloys K and M.

Figure 23:
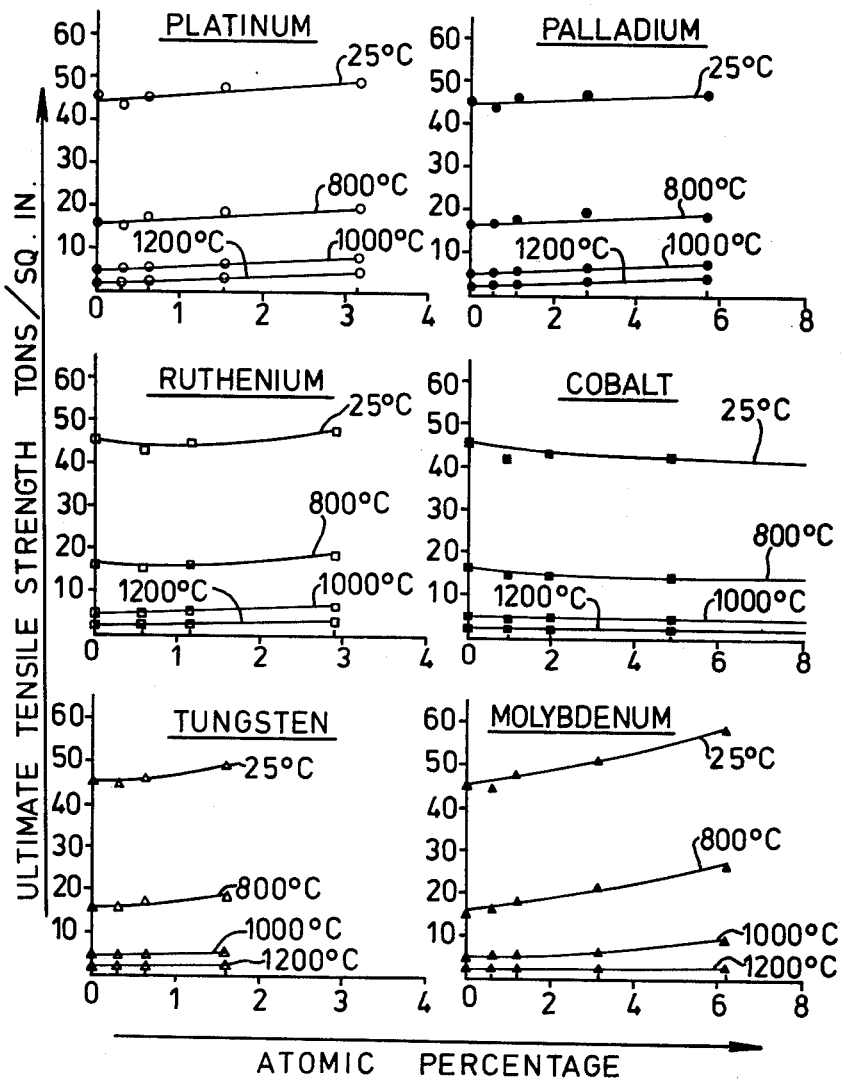
FIG. 23 is a graphic tabulation of the effect on strength of adding platinum group metals to a wrought 80/20 nickel chromium solid solution alloy.

The effects on the strength of a wrought 80/20 nickel chromium solid solution alloy of additions of platinum, palladium and ruthenium as well as cobalt, tungsten and molybdenum, which are the conventional additives to the $\gamma$ matrix, are tabulated in tables 13 and displayed graphically in FIG. 23. All the platinum group metals have a beneficial effect on the hot strength of the base alloy and, when compared on an atomic percentage basis, are as effective as the conventional additives of refractory metals molybdenum and tungsten. Cobalt is not added primarily for solid solution strengthening as is evident from its weakening effect, but its presence does raise the precipitate solutioning temperature in $\gamma/\gamma'$ alloys.

From the foregoing it will be appreciated that modification of nickel and cobalt base alloys by enrichment with a platinum group metal as herein defined produces beneficial effects on mechanical strength and creep resistance at elevated temperature and at the same time improves the oxidation and sulphidation behaviour of the alloys.

Our investigation has shown that the platinum metal addition partitions preferentially to the $\gamma'$ phase in the proportion of at least 2:1. In the wrought nickel base alloys where the volume % of $\gamma$ is small (as dictated by the Al + Ti content) a significant proportion of the platinum modified addition is left in solution in the $\gamma$ phase to impart solid solution strengthening. Where the volume % of the $\gamma'$ phase is large, as in the high strength case nickel base alloys K and M, most of the platinum modified enrichment is present in the $\gamma'$ phase. Although this occurrence leads to a solid strengthening of $\gamma'$, the effect on the overall performance of the two phase alloy is small or even diminishing at intermediate temperatures. At high temperatures, above 1100° C, the platinum enriched $\gamma'$ phase does contribute to strength improvements by virtue of its increased propensity and higher solutioning temperature.

As far as oxidation and hot corrosion resistance are concerned, one weakness in cast nickel base superalloys is the relatively poor corrosion resistance of the $\gamma'$ phase. This is, however, improved significantly by the presence of platinum in accordance with the present invention and acts in the same direction as additions of chromium. Chromium additions, however, partition equally between the two phases and are limited by the refractory metal content in order to avoid undesirable phase precipitations in the $\gamma$ matrix.

The addition of a platinum group metal as herein defined in an amount of a trace to 15 wt.% in accordance with this invention provides:

a. improvements in elevated temperature strength and creep resistance without detriment to oxidation or hot corrosion resistance for the relatively lowly alloyed, intermediate strength, wrought nickel base superalloys;

b. improvements in elevated temperature oxidation and corrosion resistance without detriment to strength and creep resistance for the highly alloyed, high strength, cast nickel base superalloys; and c. improvements in both elevated temperature strength and corrosion resistance to all cobalt based superalloys.

Generally speaking, oxidation resistance is of prime concern in the aerospace industry, whereas sulphidation is of paramount importance in marine environments and industrial gas turbines where downgraded fuels rich in sulphur are finding increasing employment.

An alloy in accordance with this invention may be used to form at least a part of the operating surface of an electrode used in an igniter suitable for igniting combustible gases or mixtures thereof. Typically, the igniters may be use in gas turbines and jet engines. Alternatively, the electrode per se may be made entirely from the alloy. In the formation of an electrode having the operating surface, or part thereof, made from an alloy of the invention, a surface layer of a platinum group metal or of an alloy of one or more of these metals may be applied to a substrate made from a superalloy as herein defined and the assembly heated to effect interdiffusion between the surface layer and the substrate, so as to form a surface layer or zone of an alloy according to the invention, in the electrode.

Such a process may in general be used to form a surface layer or zone of an alloy according to the invention on a body formed of a "superalloy" so as to increase, for example, the corrosion and sulphidation-resistance of the body.

TABLE 3.1

Tensile Data for Alloys J and K.

1. Room Temperature Properties

| Property | Alloy J. | Alloy K. |
|---|---|---|
| $HV_{10}$ | 452 | 492 |
| U.T.S. | 147,000 psi | 157,000 psi |
| % El | 3.2% | 7.1% |

TABLE 3.2

2. Elevated Temperature Properties

| | 1000° C | | 1100° C | | 1200° C | |
|---|---|---|---|---|---|---|
| Property | Alloy J. | Alloy K. | Alloy J. | Alloy K. | Alloy J. | Alloy K. |
| U.T.S. | 81,600 psi | 84,400 psi | 42,600 psi | 41,500 psi | 9,600 psi | 12,200 psi |
| % El | 6.0% | 3.0% | 7.5% | 4.3% | 23.0% | 17.0% |

TABLE 4.

Stress Rupture Data for Alloys J and K.

| Test | Alloy J. | | Alloy K. | |
|---|---|---|---|---|
| Temp. | Rupture Life | Min.Creep Rate | Rupture Life | Min.Creep Rate |
| 1000° C | 681.0 hrs | $1.90\times10^{-3}$%/hr | 360.6 | $8.93\times10^{-3}$%/hr |
| 1050° C | 128.4 hrs | $7.40\times10^{-3}$%/hr | 137.5 hrs | $3.15\times10^{-3}$%/hr |
| 1100° C | 8.4 hrs | 0.137%/hr | 10.7 hrs | 0.130%/hr |

Results quoted denote the average value of at least two determinations.

TABLE 5.1

OXIDATION DATA FOR ALLOYS J AND K.
Isothermal oxidation in still air at 1100° C

| Time at Temperature in hrs. | Specific Weight Change in mg/cm² ALLOY J | ALLOY K |
|---|---|---|
| 1 | 0.252 | 0.365 |
| 4 | 0.661 | 0.487 |
| 9 | 0.882 | 0.520 |
| 16 | 1.008 | 0.509 |
| 25 | 1.260 | 0.609 |
| 36 | 1.323 | 0.623 |
| 49 | 1.480 | 0.664 |
| 74 | 1.480 | 0.731 |
| 100 | 1.545 | 0.731 |

TABLE 5.2

Cyclic oxidation in air at 1100° C (1 CYCLE : 40 mins. at 1100° C followed by 20 mins. cooling to room temperature)

| No. of Cycles | Specific Weight Change in mg/cm² ALLOY J | ALLOY K. |
|---|---|---|
| 20 | − 50.0 | −12.0 |
| 40 | −128.0 | −26.0 |
| 60 | −220.0 | −40.0 |
| 80 | −310.0 | −58.0 |
| 100 | −376.0 | −84.0 |

TABLE 6

SULPHIDATION DATA FOR ALLOYS J AND K.

| IMMERSION PERIOD IN HRS | DESCALED WEIGHT LOSS IN MG/cm² ALLOY J. | ALLOY K. |
|---|---|---|
| 1 | 45.8 | 2.8 |
| 2 | 76.2 | 3.4 |
| 5 | 178.4 | 4.2 |
| 15 | 446.1 | 4.1 |
| 25 | 653.2 | 4.2 |
| 40 | 919.7 | 3.5 |

Results from total immersion crucible test in 10% Na Cl / 90% $Na_2SO_4$ at 925° C.

TABLE 7.1

TENSILE DATA FOR ALLOYS J AND K.

1. Room Temperature Properties

| Property | ALLOY J | ALLOY K. |
|---|---|---|
| $HV_{10}$ | 417 | 468 |
| U.T.S. | 137,200 psi | 155,000 psi |
| % El | 8.0% | 3.0% |

TABLE 7.2

2. Elevated Temperature Properties

| Property | 1000° C ALLOY J. | 1000° C ALLOY K. | 1200° C ALLOY J. | 1200° C ALLOY K. |
|---|---|---|---|---|
| U.T.S. | 71,100 psi | 69,600 psi | 11,700 psi | 13,700 psi |
| % El | 8.0% | 9.0% | 13.0% | 4.0% |

TABLE 8.1

Oxidation Data for Alloys L. and M.
Isothermal oxidation in still air at 1100° C

| Time at Temperature in hrs | Specific Weight Change in mg/cm² ALLOY L. | ALLOY M. |
|---|---|---|
| 1 | 0.200 | 0.131 |
| 4 | 0.400 | 0.311 |
| 9 | 0.515 | 0.393 |
| 16 | 0.572 | 0.426 |
| 25 | 0.744 | 0.557 |
| 36 | 0.850 | 0.606 |
| 49 | 0.877 | 0.612 |
| 74 | 1.001 | 0.738 |
| 100 | 1.068 | 0.852 |

TABLE 8.2

Cyclic Oxidation in air at 1100° C
(1 cycle : 40 mins at 1100° C followed by 20 mins cooling to room temperature)

| No. of Cycles | Specific Weight Change in mg/cm² ALLOY L | ALLOY M |
|---|---|---|
| 20 | − 7.75 | −3.30 |
| 40 | −11.50 | −5.75 |
| 60 | −18.70 | −7.25 |
| 80 | −31.80 | −8.50 |
| 100 | −55.50 | −8.90 |

TABLE 9

SULPHIDATION DATA FOR ALLOYS L AND M.

| Immersion Period in Hours | Descaled Weight Loss in mg/cm² | |
|---|---|---|
| 1 | 69.22 | 1.36 |
| 2 | 151.41 | 1.52 |
| 5 | 543.13 | 1.60 |
| 15 | Specimen Destroyed | 1.76 |
| 40 | — | 2.16 |
| 90 | — | 3.49 |

Results from total immersion crucible test in 10% NaCl/90% $Na_2SO_4$ at 925° C.

TABLE 10.1

Tensile Data for Alloy N.

1. Room Temperature Properties

| Property | Base Alloy* | Alloy N. |
|---|---|---|
| $HV_{10}$ | 330 | 370 |
| U.T.S. | 113,000 psi | 129,100 psi |
| % El | 3.5% | 2.0% |

*Published data from MAR M 509 Alloy Digest, Nov. 1967.

TABLE 10.2

2. Elevated Temperature Properties

| Property | 1000° C Base Alloy* | 1000° C Alloy N. | 1200° C Base Alloy* | 1200° C Alloy N. |
|---|---|---|---|---|
| U.T.S. | 36,500 psi | 41,500 psi | 9,600 psi | 14,400 psi |
| % El | 25.5% | 20.0% | | 10.0% |

*Published data from MAR M 509 Alloy Digest, Nov. 1967.

TABLE 11.1

Oxidation Data for Alloy N.

(a) Isothermal oxidation in still air at 1100° C

| Time at Temp. in hrs | Specific weight change in mg/cm² Published Data* Base Alloy | Alloy N. |
|---|---|---|
| 1 | 0.8 | 0.318 |
| 4 | 1.2 | 1.124 |
| 9 | 2.2 | 1.760 |
| 16 | 3.0 | 2.079 |
| 25 | 3.8 | 2.660 |
| 36 | 4.8 | 2.978 |
| 49 | 5.9 | 3.277 |
| 64 | 7.1 | 3.464 |
| 81 | 8.7 | 3.727 |
| 100 | 10.2 | 4.045 |

*M.J. Woulds T.R. Cass Cobalt, No.42 March 1969, pp. 3–13

TABLE 11.2

(b) Cyclic oxidation in air at 1100° C (1 cycle : 40 mins at 1100° C followed by 20 mins cooling room temperature)

| No. of Cycles | Specific weight change in mg/cm² Alloy N. |
|---|---|
| 20 | − 49.2 |
| 40 | −119.1 |
| 60 | −198.4 |
| 80 | −261.2 |
| 100 | −316.8 |

TABLE 12.

Sulphidation Data for Alloy N.

| Immersion Period in hrs | Descaled weight loss in mg/cm² |
|---|---|
| 10 | 33.5 |
| 15 | 44.1 |
| 25 | 45.7 |
| 40 | 50.5 |
| 75 | 51.6 |
| 90 | 38.1 |

TABLE 13.1

Comparative Effect on the Elevated Temperature Strength and Ductility of Wrought 80% Nickel – 20% Chromium of both Precious Metal and Conventional Alloying Additions (a) Wrought 80% Nickel – 20% Chromium Base Alloy

| Temperature | Yield Stress | Ult. Tensile Strength | % Elongation |
|---|---|---|---|
| 25° C | 19.35 | 45.25 | 40.0 |
| 800° C | 11.18 | 15.85 | 37.9 |
| 1000° C | 4.25 | 4.7 | 17.5 |
| 1200° C | 1.72 | 2.14 | 28.8 |

Note:
ALL yield stress and ultimate tensile strengths are quoted in tons/sq.in.
% elongation figures refer to the extension of a 1mm dia. wire over a gauge length of 50 mm.

TABLE 13.2

(b) Base Alloy + Platinum

| Temp. | 1 wt % Pt | | | 2 wt % Pt | | | 5 wt % Pt | | | 10 wt % Pt | | |
|---|---|---|---|---|---|---|---|---|---|---|---|---|
| C° | Y.S. | UTS | %El | Y.S. | UTS | %El | Y.S. | UTS | %El | Y.S. | UTS | %El |
| 25 | 18.1 | 43.6 | 43.3 | 19.6 | 45.1 | 41.5 | 22.1 | 47.3 | 41.0 | 24.8 | 49.0 | 36.5 |
| 800 | 11.4 | 15.7 | 35.8 | 11.2 | 17.2 | 34.2 | 12.5 | 18.2 | 31.3 | 14.7 | 19.9 | 23.7 |
| 1000 | 4.4* | 4.7 | 28.7 | 5.2* | 5.5 | 24.3 | 6.3* | 6.4 | 16.7 | 7.8* | 7.8 | 11.0 |

TABLE 13.2-continued (b) Base Alloy + Platinum

| Temp. | 1 wt % Pt | | | 2 wt % Pt | | | 5 wt % Pt | | | 10 wt % Pt | | |
|---|---|---|---|---|---|---|---|---|---|---|---|---|
| C ° | Y.S. | UTS | %El | Y.S. | UTS | %El | Y.S. | UTS | %El | Y.S. | UTS | %El |
| 1200 | 1.9 | 2.2 | 25.6 | 2.4* | 2.6 | 22.5 | 3.4* | 3.4 | 14.8 | 4.6* | 4.6 | 12.0 |

Note:
*Denotes specimens displaying yield point phenomena when the yield stress was taken as the stress corresponding to the limit of proportionality.
ALL yield stress and ultimate strengths are quoted in tons/sq.in.
% elongation figures refer to the extension of a 1mm dia. wire over a gauge length of 50mm.

TABLE 13.3

(c) Base Alloy + Palladium

| Temp. | 1 wt % Pd | | | 2 wt % Pd | | | 5 wt % Pd | | | 10 wt % Pd | | |
|---|---|---|---|---|---|---|---|---|---|---|---|---|
| C ° | Y.S. | UTS | %El | Y.S. | UTS | %El | Y.S. | UTS | %El | Y.S. | UTS | %El |
| 25 | 18.6 | 44.1 | 41.5 | 20.4 | 45.4 | 41.3 | 22.3 | 46.5 | 43.3 | 23.2 | 47.1 | 44.5 |
| 800 | 10.5 | 16.4 | 33.9 | 11.8 | 17.2 | 35.4 | 2.9 | 19.0 | 25.2 | 11.8 | 18.6 | 21.6 |
| 1000 | 4.9* | 4.9 | 24.3 | 5.5* | 5.5 | 24.7 | 6.7* | 6.7 | 16.4 | 7.6* | 7.6 | 9.7 |
| 1200 | 2.8* | 2.3 | 22.9 | 2.6* | 2.4 | 24.6 | 3.4* | 3.4 | 19.8 | 4.2* | 4.2 | 9.3 |

Note:
*Denotes specimens displaying yield point phenomena when the yield stress was taken as the stress corresponding to the limit of proportionality.
ALL yield stress and ultimate tensile strengths are quoted in tons/sq.in.
% elongation figures refer to the extension of a 1mm dia. wire over a gauge length of 50 mm.

TABLE 13.4

(d) Base Alloy + Ruthenium

| Temp. | 1 wt % Ru | | | 2 wt % Ru | | | 5 wt % Ru | | |
|---|---|---|---|---|---|---|---|---|---|
| C ° | Y.S. | UTS | El% | Y.S. | UTS | El% | Y.S. | UTS | El% |
| 25 | 16.9 | 43.1 | 42.3 | 18.6 | 44.8 | 42.5 | 22.9 | 47.9 | 44.5 |
| 800 | 9.6 | 15.6 | 31.3 | 11.8 | 16.3 | 28.1 | 13.0 | 18.7 | 23.3 |
| 1000 | 4.1 | 4.7 | 21.6 | 5.1* | 5.2 | 17.0 | 6.6* | 6.6 | 15.2 |
| 1200 | 1.8 | 2.2 | 13.8 | 2.1* | 2.3 | 16.2 | 2.9* | 2.9 | 9.2 |

Note:
*Denotes specimens displaying yield point phenomena when the yield stress was taken as the stress corresponding to the limit of proportionality.
ALL yield stress and ultimate tensile strengths are quoted in tons/sq.in.
% elongation figures refer to the extension of a 1mm dia. wire over a gauge length of 50mm.

TABLE 13.5

(c) Base Alloy + Cobalt

| Temp. | 1 wt % Co | | | 2 wt % Co | | | 5 Wt % Co | | | 10 wt % Co | | |
|---|---|---|---|---|---|---|---|---|---|---|---|---|
| C ° | Y.S. | UTS | El% | Y.S. | UTS | El% | Y.S. | UTS | El% | Y.S. | UTS | El% |
| 25 | 15.7 | 42.1 | 42.8 | 16.7 | 43.0 | 41.3 | 16.4 | 42.6 | 42.5 | 15.1 | 41.6 | 43.3 |
| 800 | 10.8 | 14.4 | 40.0 | 10.6 | 14.6 | 43.0 | 9.0 | 14.6 | 41.7 | 9.7 | 13.9 | 42.7 |
| 1000 | 3.9 | 4.6 | 32.0 | 4.3 | 4.9 | 26.9 | 3.8 | 4.7 | 29.0 | 3.5 | 4.5 | 16.8 |
| 1200 | 1.6 | 2.0 | 32.0 | 1.7 | 2.2 | 14.8 | 1.6 | 2.1 | 40.0 | 1.5 | 2.1 | 20.5 |

Note:
ALL yield stress and ultimate tensile strengths are quoted in tons/sq.in.
% elongation figures refer to the extension of a 1mm dia. wire over a gauge length of 50 mm.

TABLE 13.6

(f) Base Alloy & Tungsten

| Temp | 1 wt % W | | | 2 wt % W | | | 5 wt % W | | |
|---|---|---|---|---|---|---|---|---|---|
| C ° | Y.S. | UTS | El% | Y.S. | UTS | El% | Y.S. | UTS | El% |
| 25 | 18.1 | 44.5 | 39.5 | 19.5 | 46.0 | 36.5 | 21.7 | 49.1 | 42.8 |
| 800 | 11.5 | 15.3 | 34.2 | 12.2 | 17.2 | 31.4 | 13.2 | 18.7 | 19.7 |
| 1000 | 4.3* | 4.7 | 30.7 | 4.7* | 4.8 | 27.6 | 5.7* | 5.4 | 24.5 |

TABLE 13.6-continued (f) Base Alloy & Tungsten

| Temp | 1 wt % W | | | 2 wt % W | | | 5 wt % W | | |
|---|---|---|---|---|---|---|---|---|---|
| C ° | Y.S. | UTS | El% | Y.S. | UTS | El% | Y.S. | UTS | El% |
| 1200 | 1.7 | 2.2 | 21.2 | 1.8* | 2.2 | 20.6 | 2.2* | 2.2 | 13.4 |

Note:
*Denotes specimens displaying yield point phenomena when the yield stress was taken as the stress corresponding to the limit of proportionality.
ALL yield stress and ultimate tensile strengths are quoted in tons/sq.in.
% elongation figures refer to the extension of a 1mm dia. wire over a gauge length of 50mm.

TABLE 13.7

(g) Base Alloy & Molybdenum

| Temp. | 1 wt % Mo | | | 2 wt % Mo | | | 5 wt % Mo | | | 10 wt % Mo | | |
|---|---|---|---|---|---|---|---|---|---|---|---|---|
| C ° | Y.S. | UTS | El% | Y.S. | UTS | El% | Y.S. | UTS | El% | Y.S. | UTS | El% |
| 25 | 18.2 | 44.7 | 42.3 | 20.2 | 47.6 | 39.0 | 23.4 | 51.5 | 42.0 | 28.2 | 58.4 | 42.8 |
| 800 | 12.6 | 16.1 | 42.1 | 12.5* | 18.0 | 28.5 | 15.4* | 21.3 | 37.7 | 19.3* | 26.7 | 40.1 |
| 1000 | 4.2 | 4.6 | 21.2 | 5.1* | 5.3 | 23.8 | 6.4* | 6.0 | 25.4 | 9.5* | 9.5 | 30.2 |
| 1200 | 1.9* | 2.2 | 26.6 | 2.1* | 2.2 | 11.0 | 2.7* | 2.52 | 16.4 | 3.6* | 2.9 | 20.0 |

Note:
ALL yield stress and ultimate tensile strengths are quoted in tons/sq.in.
% elongation figures refer to the extension of a 1mm dia. wire over a gauge length of 50mm.
*Denotes specimens displaying yield point phenomena when the yield stress was taken as the stress corresponding to the limit of proportionality.

What we claim is:

1. An alloy consisting essentially apart from impurities of 75.4 wt.% nickel, 17.7 wt.% chromium, 1.06 wt.% aluminium and 5.07 wt.% platinum.

2. An alloy consisting essentially, apart from impurities nickel. 14.9 wt.% chromium, 1.1 wt.% aluminum and 11.1 wt.% platinum.

3. An alloy consisting essentially, apart from impurities 67.3 wt.% nickel, 15.9 wt.% chromium, 1.37 wt.% aluminum and 14.6 wt.% platinum.

4. An alloy consisting essentially, apart from impurities of 71.3 wt.% nickel, 12.7 wt.% chromium, 4.09 wt.% aluminum and 10.14 wt.% platinum.

5. An alloy consisting essentially, apart from impurities of 57.8 wt.% nickel, 14.8 wt.% chromium, 13.5 wt.% cobalt, 2.1 wt.% titanium, 1.8 wt.% aluminum, 9.2 wt.% platinum, 6. An alloy consisting essentially, apart from impurities of 53.0 wt.% nickel, 8.0 wt.% chromium, 9.5 wt.% cobalt, 11.4 wt.% tungsten, 1.5 wt.% niobium, 5.1 wt.% aluminum, 1.7 wt.% titanium, 0.09 wt% carbon, 0.02 wt.% boron, 0.07 wt.% zirconium, and 9.9 wt.% platinum.

7. An alloy consisting essentially, apart from impurities 53.3 wt.% nickel, 8.0 wt.% chromium, 10.0 wt.% cobalt, 6.0 wt.% aluminium, 1.0 wt.% titanium, 0.10 wt.% carbon, 0.015 wt.% boron, 0.10 wt.% zirconium, 10.0 wt.% platinum, 6.0 wt.% molybdenum, 4.0 wt.% tantalum and 1.5 wt.% hafnium.

8. An alloy consisting essentially, apart from impurities 10.0 wt.% nickel, 23.5 wt% chromium, 44.7 wt.% cobalt. 7.0 wt.% tungsten, 0.2 wt.% titanium, 0.6 wt.% carbon, 0.5 wt.% zirconium, 10.0 wt.% platinum.

* * * * *